US005095864A

United States Patent [19]

Bolenz et al.

[11] Patent Number: 5,095,864

[45] Date of Patent: Mar. 17, 1992

[54] STARTING DEVICE FOR INTERNAL COMBUSTION ENGINES

[75] Inventors: Klaus Bolenz, Schwieberdingen; Hans Wuerth, Ludwigsburg, both of Fed. Rep. of Germany

[73] Assignee: Robert Bosch GmbH, Stuttgart, Fed. Rep. of Germany

[21] Appl. No.: 602,322

[22] PCT Filed: May 20, 1989

[86] PCT No.: PCT/DE89/00319

§ 371 Date: Nov. 28, 1990

§ 102(e) Date: Nov. 28, 1990

[87] PCT Pub. No.: WO89/12164

PCT Pub. Date: Dec. 14, 1989

[30] Foreign Application Priority Data

Jun. 6, 1988 [DE] Fed. Rep. of Germany ..... 3819219

[51] Int. Cl.[5] ..... F02N 11/08

[52] U.S. Cl. ..... 123/179.1; 290/38 R

[58] Field of Search ..... 123/179 R, 179 B, 179 M; 290/38 R

[56] References Cited

U.S. PATENT DOCUMENTS

| | | | |
|---|---|---|---|
| 1,279,907 | 9/1918 | Reinhold | 123/179 B |
| 2,115,671 | 4/1938 | Pfister | 290/38 R |
| 2,930,901 | 3/1960 | Freeman | 290/38 R |

FOREIGN PATENT DOCUMENTS

| | | | |
|---|---|---|---|
| 704133 | 3/1941 | Fed. Rep. of Germany . | |
| 816532 | 8/1937 | France . | |
| 2223565 | 10/1974 | France . | |
| 144091 | 9/1980 | German Democratic Rep. | 290/38 R |
| 205962 | 1/1984 | German Democratic Rep. | 290/38 R |
| 451212 | 7/1936 | United Kingdom | 290/38 R |

*Primary Examiner*—Andrew M. Dolinar
*Attorney, Agent, or Firm*—Michael J. Striker

[57] ABSTRACT

In a starter device having two starters (11, 12) operating in parallel mode, for the purpose of ensuring that the switching on of the drive motors (17, 18) for the drive of the starting pinions occurs only after engagement of the latter, the relay windings (21, 22) of the starting relays (19, 20) which push the starting pinions forwards, are connected in parallel to one another and in such a way that they are excited simultaneously when the starter switch (16) is activated. After complete engagement of the starting pinions, in each starter (11, 12), switching contacts (27–30) are activated, of which two switching contacts (27, 30 or 28, 29) associated, in each case, with two different starters (11, 12), are series-connected and connected in series to, in each case, one drive motor (17 or 18). Thus, if necessary, the switching on of the drive motors (17, 18) is blocked as long as one of the two starting pinions is not engaged.

4 Claims, 2 Drawing Sheets

STARTING DEVICE FOR INTERNAL COMBUSTION ENGINES

BACKGROUND OF THE INVENTION

The invention relates to a starting device for internal combustion engines, in particular of large combustion engines having two starters operating in parallel mode each of which has a starting pinion which can be driven by an electrical drive motor, a starting relay which engages in a gear wheel of the internal combustion engine when the starting pinion is excited, and a switch which closes at the end of the engagement process. A starter switch connects the starting relay to a power supply and has switching means for connecting the drive motors to the power supply only after engagement of both starting pinions has occurred.

In a known starting device with double starter of this kind, the switching means for supplying the two drive motors with power, after the starting pinions of both starters have been engaged in the gear ring of the internal combustion engine, includes a double starting relay the two switching contacts of which produce a direct electrical connection of the drive motors to the electrical system of the vehicle. The switches actuated by the two starting pinions or starting relay at the end of the engagement process each have a switching contact. With the closing of the starter switch, the starting relay of the one starter is connected to the vehicle electrical system. If its drive pinion is engaged, the switching contact of the associated switch closes and ensures a DC current flow in the starting relay of the other starter. The starting relay engages the starting pinion likewise into the gear ring of the internal combustion engine. If this starting pinion is also engaged, the two excitation windings of the double starting relay connected in parallel are supplied with DC current via the switching contact of the associated switch which is now also closed, so that the two relay contacts of said double starting relay close. Via the relay contacts, each drive motor of the two starters is now connected to the vehicle electrical system.

SUMMARY OF THE INVENTION

The object of the invention is a starting device in which the double starting relay and corresponding line connections can be dispense with. The object of the invention is achieved by providing a starting device in which the relay windings of the starting relays are parallel to one another and are connected in such a way that they are excited simultaneously when the starter switch is actuated. The switching means is formed by switching contacts of the switches, of which in each case switching contacts associated with two different starters are series-connected and connected in series to, in each case, one drive motor. In addition, there is a shorter switching time in the event of mimic connections, since the actuation of both starters occurs at the same time and not successively.

In a further embodiment of the invention, the hitherto conventional switches with a single switching contact are replaced by, in each case, one switch with a double contact, while in the still another embodiment of the invention the single switching contacts of the two switches associated in each case with one starter must be designed for twice the current load, since the current for both drive motors connected in parallel is directed via the two switching contacts arranged in series.

The present invention both as to its construction so to its mode of operation, together with additional objects and advantages thereof, will be best understood from the following detailed description of preferred embodiments when read with reference to the appended drawings.

DESCRIPTION OF THE PREFERRED EMBODIMENTS

Figure 1:
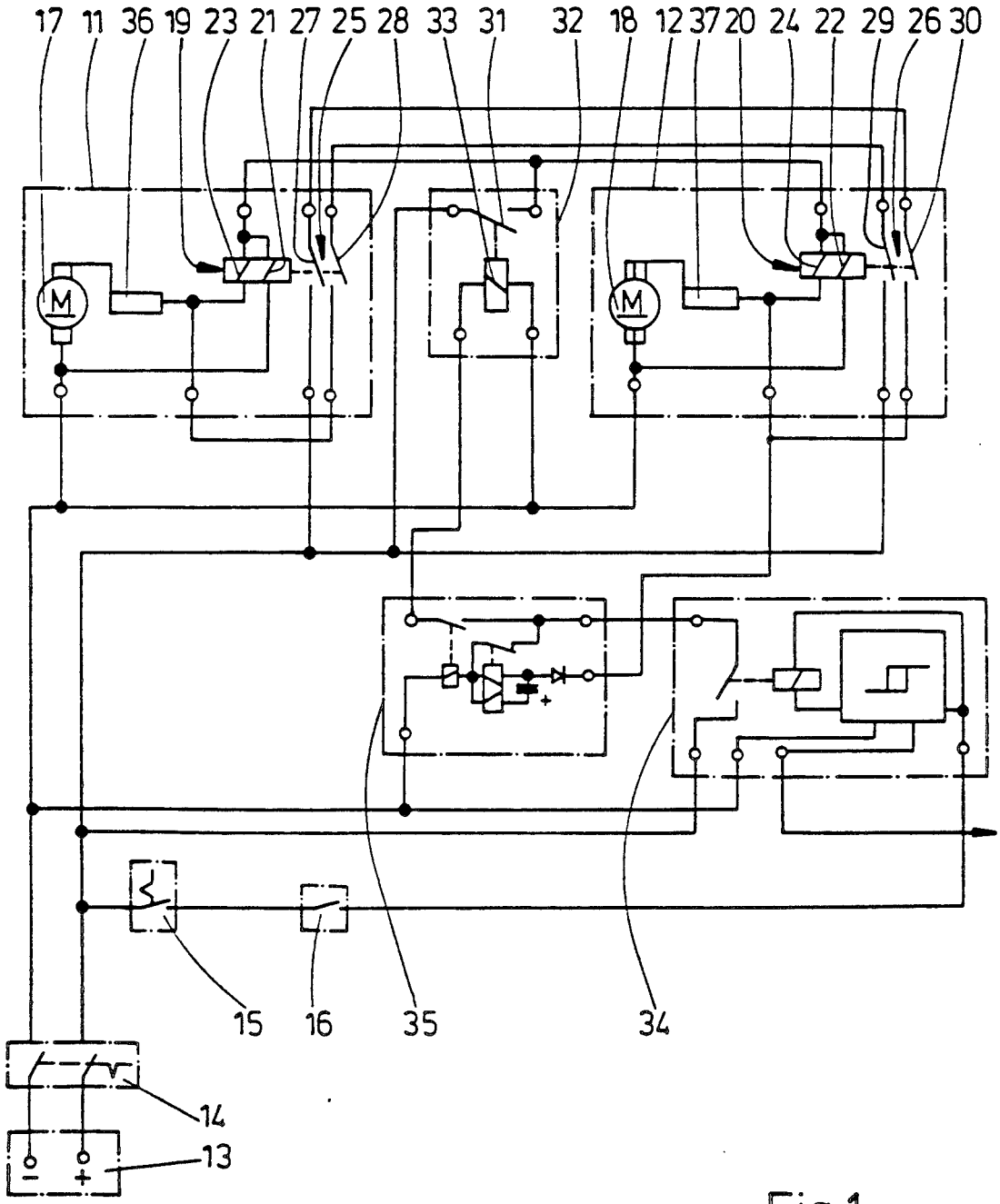
FIGS. 1 and 2 show, respectively, first and second embodiments of a circuit diagram of a starting device having two starters, operated in parallel, for an internal combustion engine according to the invention.

The starting device, illustrated in the circuit diagram in FIG. 1, for an internal combustion engine of a motor vehicle has two starters 11,12 operating in parallel mode. The motor vehicle battery is designated by 13, a battery switch by 14, a drive switch by 15 and a starter switch for starting the internal combustion engine by 16. If battery switch 14 and drive switch 15 are closed, the two starters 11,12 can be switched on by actuating the starter switch 16, the starting pinions (not shown here) of said starters 11,12 engaging in the gear ring of an internal combustion engine and starting the internal combustion engine after the drive motors 17,18 of the starters 11,12 have been switched on.

Each starter 11 or 12 has, in addition to the drive motor 17 or 18, a starting relay 19 or 20 for driving the starting pinion and having at least one relay winding 21, 22. Given DC current flow in the relay winding 21 or 22, the starting relay 19 or 20 is triggered and pushes the starting pinion into the gear ring of the internal combustion engine. A possible constructional design of the starter 11 or 12 is described, for example, in the German Offenlegungsschrift 3,100,869. For better engagement of the starting pinion in the gear ring of the internal combustion engine, when the starting pinion is pushed against the gear ring, the starting pinion is slowly turned. This can be effected mechanically, as described in the aforementioned German Offenlegungsschrift, by screwing the pinion onto a transmission shaft, but also electrically—as is the case here—by means of low current flow in the drive motor 17 or 18, which occurs here via a second relay winding 23 or 24 of the starting relay 19 or 20. If the starting pinion can engage completely in the gear ring of the internal combustion engine, the starting relay 19 or 20 draws the relay armature in completely and, at the end of the drawing-in movement, closes a switch 25 or 26 which then connects the drive motor 17 or 18 directly to the motor vehicle battery 13.

In such a starting device having two starters operated in parallel, it is extremely important that the drive pinions of both starters are engaged in the gear ring of the internal combustion engine before the drive motors 17,18 are switched on, in order to avoid an overloading of one of the starters 11,12. For this purpose, each switch 25,26 has a double contact consisting of the switching contacts 27,28 or 29,30. The switching contact 27 of the switch 25 and the switching contact 30 of the switch 26 are series-connected and are connected in series with the drive motor 18 of the starter 12 to the battery 13. In the same way, the switching contact 29 of the switch 26 and the switching contact 28 of the switch 25 are series-connected and are now connected in series with the drive motor 17 of the starter 11 to the battery 13.

The relay windings 21,22 of the two starting relays 19 are connected in parallel to one another and are connected directly to the battery 13 via the relay contact 31 of an auxiliary relay 32. When the starter switch 16 is activated, the relay winding 33 of the auxiliary relay 32 is supplied with current, namely via a start blocking relay 34 and start repeat relay 35 known per se. The second relay windings 23 and 24 are each connected in series to the series winding 36 or 37 of the associated drive motor 17 or 18, constructed as DC series motor, parallel to the relay windings 23,24.

The mode of operation of the starting device described is as follows:

If the starter switch 16 is activated after the battery switch 14 and the drive switch 15 are closed, the relay winding 33 of the auxiliary relay 32 is connected to the motor vehicle battery 13 via the start blocking relay 34 and the start repeat relay 35. The relay contact 31 of said auxiliary relay closes and connects the two parallel relay windings 21,22 of the starting relays 19,20 to the motor vehicle battery 13. When excited, the starting relays 19,20 push the respectively associated starting pinions in the direction of the gear ring of the internal combustion engine, the starting pinions being displaced in slow rotation via the associated drive motors 17,18. As soon as the starting pinion of the starter 11 is engaged, the switching contacts 27 and 28 close. If the starting pinion of the starter 12 is not yet engaged, nothing happens. Only after complete engagement of the starting pinion of the starter 12 also, can its starting relay 20 close the two switching contacts 29,30 of the switch 26. At this moment, both drive motors 17,18 are connected via the closed double contacts of the switches 25,26 in parallel to the battery 13. The drive motors 17,18 run up and start the internal combustion engine via the starting pinions. By means of the cross-over connection of the double contacts of the switches 25,26 into the starting relays 19,20, the one starter 11 or 12 is thus blocked in respect of the other starter 12 or 11 until both starting pinions are engaged in the gear ring of the internal combustion engine. If one of the starting pinions cannot engage in a tooth-to-tooth position, the start repeat relay 35 is triggered and it repeats the starting process as described for both starters 11,12 without the drive switch 15 having to be opened and closed again.

Figure 2:
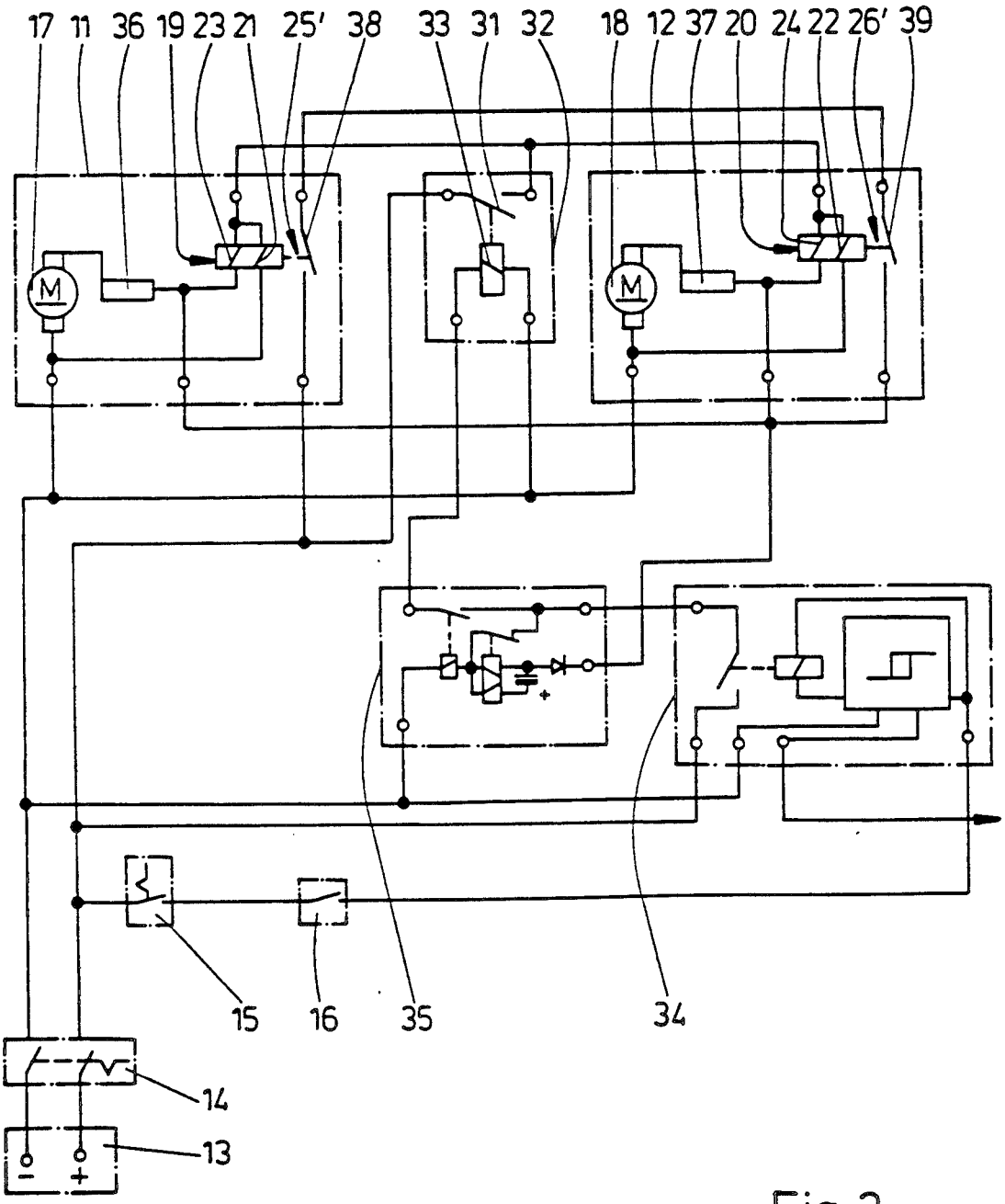

The starting device according to a further embodiment illustrated in the circuit diagram in FIG. 2 is only modified in comparison with the starting device in FIG. 1 in respect of the type of mutual blocking of the two starters 11,12 given at least one starting pinion which is not engaged. The switches 25' or 26' of the starting relays 19,20 are equipped with only one single switching contact 38,39 which is, however, designed for the double current load, as are the switching contacts 27–30 in FIG. 1. The two switching contacts 38,39 of the switches 25',26' are series-connected and then connected in series, with the parallel connection of the two drive motors 17,18, to the motor vehicle battery 13. In this case also, no drive motor 17,18 can be switched on until both pinions of the two starters 11,12 are engaged. By the series connection of both switching contacts 38,39, both starters 11,12 are blocked until both starting pinions are engaged. Only when both switching contacts 38,39 are closed after engagement of the starting pinions are the drive motors 17,18 connected to the motor vehicle battery 13 simultaneously and parallel to one another. By this modification, in comparison with the conventional starting device, in each case, one switching contact in the two switches 25',26' and corresponding connecting lines between the switches 25',26' are dispensed. However, the switching contacts 38 and 39 and the connecting lines must be designed for the double current load. Moreover, the design and the mode of operation of the starting device according to FIG. 2 is identical to the starting device according to FIG. 1 so that identical components have been provided with identical reference symbols.

While the invention has been illustrated and described as embodied in a starting device for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, form the standpoint of prior art, fairly constitute essential characteristics of the generic or specific aspects of this invention.

What is claimed as new and desired to be protected by Letters Patent is set forth in the appended claims:

1. A starting device for internal combustion engines having gear wheel means, said starting device comprising two starters operating in parallel mode and having each a starting relay for engaging the gear wheel means of the internal combustion engine upon actuation of a starting pinion of the starter and having a relay winding, and a switch closeable at an end of engagement of the starting relay with the gear wheel means of the internal combustion; two electrical drive motors for driving respective starting pinions of said two starters, said switch having contact means series-connected with a respective electrical drive motor for connecting the respective drive motor to the power supply only upon actuation of the starting pinions of both starters and series-connected with the contact means of the switch of another of the two starters; and auxiliary relay having a switching contact and winding means; and a starter switch for connecting the starting relays of the two starters to a power supply, the relay windings of the two starting relays of the two starters being parallel-connected for simultaneous excitation of the two starting relays upon actuation of said starter switch and being series-connected with said switching contact of said auxiliary relay, said winding means of said auxiliary relay being connected to the power supply upon closing of said starter switch.

2. A starting device according to claim 1, wherein the contact means of the switch of each starter comprises two contacts, one of said two contacts of the switch of one of said two starters being series-connected to one of the two contacts of the switch of another of said two starters and to one of said two drive motors.

3. A starting device according to claim 1, wherein said two electrical drive motors are connected in parallel with each other, the contact means of the switch of each starter comprising a single contact series-connected to the single contact of the switch of another of the two starters and series-connected to said two drive motors.

4. A starting device according to claim 1, and further comprising a start blocking relay and a start repeat relay connected between said auxiliary relay and said starter switch.

* * * * *